US006314965B1

(12) United States Patent
Walker

(10) Patent No.: US 6,314,965 B1
(45) Date of Patent: Nov. 13, 2001

(54) THUMB AND FINGERNAIL POLISH REMOVER DEVICE

(76) Inventor: Alvin M. Walker, 143 Lake Shore Dr. North, Palm Harbor, FL (US) 34684

( * ) Notice: Subject to any disclaimer, the term of this patent is extended or adjusted under 35 U.S.C. 154(b) by 0 days.

(21) Appl. No.: 09/750,087

(22) Filed: Dec. 29, 2000

(51) Int. Cl.[7] ..... A45D 29/17
(52) U.S. Cl. ..... 132/74.5; 15/167.3
(58) Field of Search ..... 132/73, 73.5, 73.6, 132/74.5, 75, 75.3, 75.8, 76.4; 15/104.92, 167.3, 187

(56) References Cited

U.S. PATENT DOCUMENTS

| | | | | |
|---|---|---|---|---|
| 110,959 | * | 1/1871 | Darling | 15/104.92 |
| 3,316,922 | * | 5/1967 | Seidler | 132/75 |
| 4,321,936 | * | 3/1982 | Chaconas | 132/75 |
| 4,510,954 | * | 4/1985 | Miller | 132/75 |
| 4,819,672 | * | 4/1989 | Walker et al. | 132/75 |
| 5,810,021 | * | 9/1998 | Walker | 132/74.5 |
| 5,823,203 | * | 10/1998 | Carroll et al. | 132/200 |
| 6,116,248 | * | 9/2000 | Walker | 132/74.5 |

* cited by examiner

*Primary Examiner*—Todd E. Manahan
*Assistant Examiner*—David Comstock
(74) *Attorney, Agent, or Firm*—Gipple & Hale; John S. Hale

(57) ABSTRACT

A nail polish remover device adapted for removing fingernail polish from all the fingers and thumb on a hand comprising a cylindrical receptacle defining a chamber with a plurality of integrally formed brush members secured to the inner wall of the cylindrical receptacle and extending inward into the chamber. A cover member is secured to the cylindrical receptacle so that a neck formed on one side of the cover member forms a finger insertion aperture in connection with an axially aligned splash member formed on the other side of the cover member defining a passageway leading into the bristles of the brush members positioned in the cylindrical receptacle allowing the finger of a user to be inserted for removal of nail polish from the user's fingernails.

26 Claims, 4 Drawing Sheets

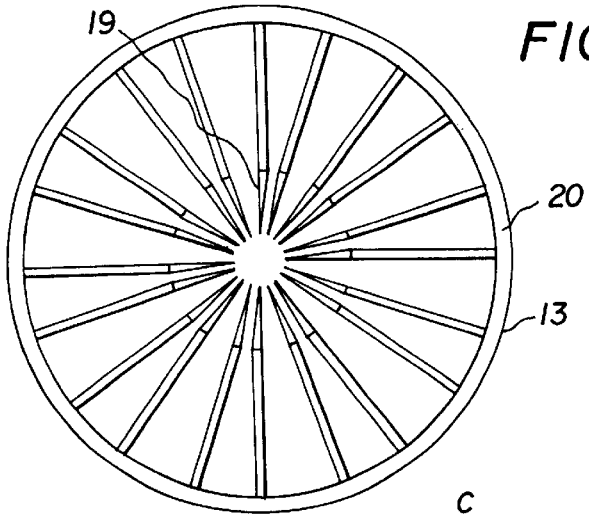
FIG. 9
FIG. 11
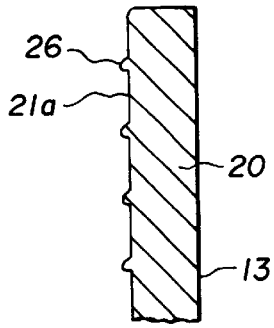
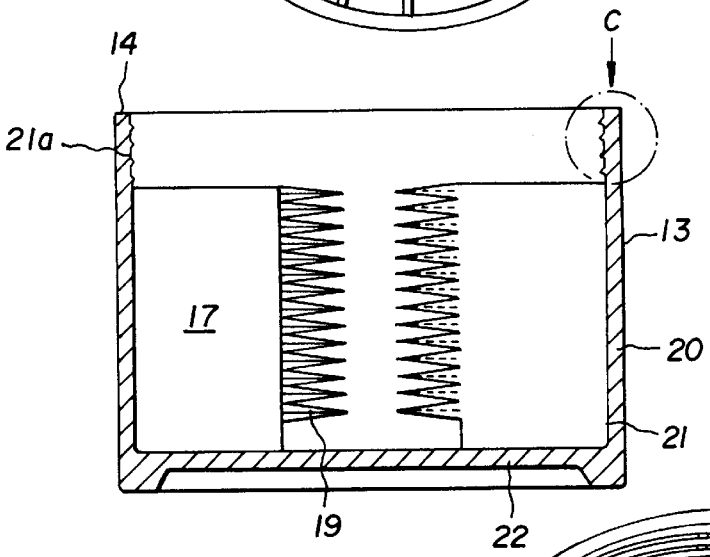
FIG. 10
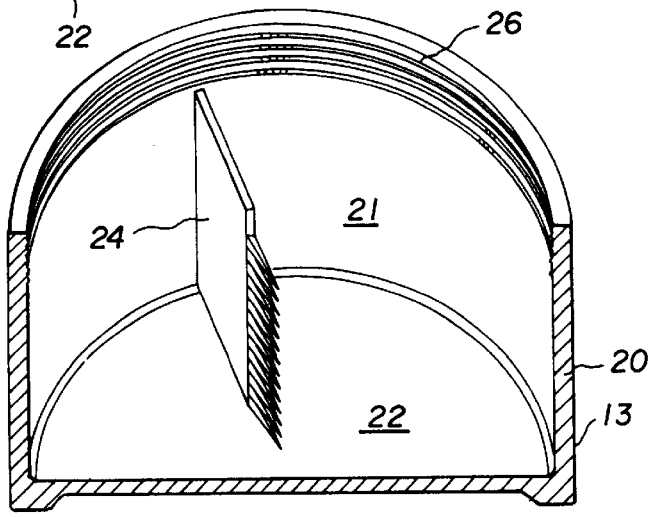
FIG. 12

THUMB AND FINGERNAIL POLISH REMOVER DEVICE

BACKGROUND OF THE INVENTION

1. Field of Invention

The present invention relates to devices for removing fingernail polish and in particular is directed towards a two piece molded container with a bottom section having a molded brush member for removing fingernail polish from a finger or thumb of either hand and a top cover section defining a downwardly projecting splash flange secured to the bottom section.

2. Description of the Prior Art

The prior art contains many references directed to nail polish removal receptacles which support or suspend an insert structure to aid in the removal of hardened nail polish from fingernails after a finger has been immersed in nail polish remover contained within the receptacle. U.S. Pat. No. 4,474,195; 4,440,181; and 4,282,891 disclose nail polish remover devices in which a receptacle is provided with a sponge or sponge-like absorbent member insert. The sponge member insert is formed with an aperture forming a finger hole into which the finger is placed. The absorbent sponge absorbs nail polish remover and upon insertion of the finger into the sponge aperture, the polished fingernail comes into contact with the sponge and nail polish remover solution to remove the polish from the nail. The solution and polish fragments are wiped from the inserted fingernail by the sponge as the fingernail is removed from the receptacle jar. A multi-layer foam surgical scrub sponge similar to those shown in the patents noted above is disclosed by U.S. Pat. No. 4,866,806. In this reference a removable serrated insert is accommodated in the center of the sponge to enable insertion of the fingers to cleanse and disinfect the cuticle areas.

U.S. Pat. No. 4,480,351 discloses a surgical scrub brush provided with two sets of brushes in each side of the molded container body. The brush bristles are formed with a configuration of smaller bristles disposed in a longitudinal channel or gap between taller bristle groups whose tips are laterally exposed to facilitate nail cleaning. The individual bristle members have a triangular cross-section.

Another surgical scrub brush is shown in U.S. Pat. No. 3,966,335. This patent features four bristle-lined troughs for simultaneous scrubbing of the four fingers. Rows of relatively short stiff bristles are used for cleaning the finger tips, nails, and under the nails.

U.S. Pat. No. 4,397,324 discloses a nail polish receptacle which is provided with a brush member disposed in the receptacle by wire legs which support the brush element in the approximate determines of a circular finger opening. Similarly, U.S. Pat. No. 4,321,936 discloses a nail polish remover receptacle containing a plurality of downwardly spaced apart free floating legs with an inwardly curved end portion. The legs have bristles or brush like elements secured thereto which extend inward. When a person inserts a finger into the device, the finger will contact the bristles and push the legs outward in such a manner that the nail polish remover liquid on the bristles will remove the nail polish from the fingernails. U.S. Pat. No. 3,316,922 discloses a nail polish remover device in which a circular brush with a circular open center is mounted on a group of abutments extending inwardly from an insert surface. The brush member is positioned on the abutments and the brush stem is moved against the abutments to snap into an inclined position. In U.S. Pat. No. 2,771,621 a reciprocating spring braced member carries a brush head with bristles extending into a recess into which a finger is placed to remove the nail polish.

U.S. Pat. Nos. 5,048,547 and 4,819,672 issued to the present inventor disclose a cylindrical housing holding a one piece brush assembly which has inwardly projecting integral triangular shaped bristles configured to receive a finger and remove the fingernail polish.

U.S. Pat. No. 5,855,212 also issued to the present inventor discloses an insert having four finger recesses and two thumb recesses with brush members integrally formed across from the respective finger and thumb recesses. The insert is mounted within the chamber of the cylindrical receptacle.

A number of patents are directed toward simultaneously cleaning the thumb and fingernails of a hand to remove the polish by brushing the same in an acetone bath. In U.S. Pat. No. 4,476,883, an U-shaped container assembly is disclosed for applying a predetermined liquid or solution to the fingernails of a person. A sponge material is disposed in the interior of a housing and is provided with a plurality of recesses dimensioned and configured to receive the fingertip and the fingernail of the user in a predetermined array facilitating placement of all the fingers and thumbs in the various recesses. A liquid or solution is applied to the interior of the housing and the sponge material and the housing is filled to a level sufficient to form small pools in the bottom of each of the finger recesses.

U.S. Pat. No. 5,823,203 discloses a nail polish remover container with a flexible strip of high density polyurethane which is coiled around the inner cylindrical wall of the inner receptacle. The brush strip is seated on an upwardly facing ledge formed on the inner receptacle which is in turn nested within the outer housing of the container. The top of the brush strip is held in place by a skirt member which is frictionally press fit against the top portion of the inner cylindrical wall of the inner receptacle.

A spherical shaped finger support and locating device guides the fingers and thumb of the user against the brush strip.

Another thumb and finger cleaner, U.S. Pat. No. 5,065,778 discloses a fingernail polish removing container with a base, and a lid, and a fingernail scrubbing structure mounted within the container in spaced relation to the container base bottom wall and to the lid top wall. In some of the disclosed embodiments the fingernail scrubbing structure is supported within the container base, and includes five finger bore openings, four of which are of substantially equal diameter with the center points located on the circumference of a circle with the fifth bore opening being positioned closer to the center point of the circle. This thumb tip receiving opening is of greater diameter than the other four finger openings and displaced closer to the center point of the fingernail scrubbing structure to receive simultaneously the fingernails of the fingers and thumb of one hand. The finger bore openings are provided with sponge inserts which are seated on a bottom circular step formed around the base of the cylindrical members which are axially aligned with the finger bore openings. The sponge inserts remove nail polish from the nails, and the nail polish removing liquid is sloshed between the bottom and the upper chambers to saturate the finger bore opening wall surfaces.

U.S. Pat. No. 6,116,248 provides for an injection molded nail cleaning apparatus receptacle allowing fingernail cleaning and conditioning, through the use of an insert having individual insertable brush bristle liner members which are mounted next to the finger holes. The device is made of three separate injection molded components: the container, the brush holder insert assembly which is provided with five vertical semi-cylindrical brush supports, each of which is provided with inwardly angled end flanges to hold individual brush bristle liner members in place and a cap. The brush holder insert can be snap fit in the container or friction welded onto the top portion of the container. Each brush or bristle liner member is molded flat then bent into a semicircular configuration to fit into the semicylindrical brush supports extending downward from the top disk member.

It can thus be seen that the aforenoted patents do not teach or disclose the present invention which utilizes a two piece molded jar assembly having a top insert member formed with external interference barbs which engage the inner wall of the cylindrical brush container and a downwardly projecting splash flange which keeps fluid from spilling out of the body of the jar and directs the finger into the bristle brush area The jar body is formed with a number of individual bristle ribs which project inwardly toward the center of the central axis of the jar to define a finger insertion brush area providing a simple means of removing nail polish from the thumb nail and fingernails of each hand in a clean environment relatively free of bacteria and virus. Many of the above cited patents use sponge or sponge-like product to apply nail polish remover to the fingernails. There are health reservations about the use of sponge product in beauty salons because of the occurrence of bacterial collection and growth in the sponge.

SUMMARY OF THE INVENTION

The present invention provides for a unique injection molded nail cleaning two piece cylindrical jar assembly having a top insert member formed with external interference barbs and a downwardly projecting splash flange which keeps fluid from spilling out of the body of the jar. The jar body is formed with a number of individual bristle nibs which project inwardly toward the center of the central axis of the jar to define a finger insertion area providing a simple means of removing nail polish from the thumb nail and fingernails of each hand in a clean environment relatively free of bacteria and virus.

It is an object of the invention that the bristle sections provides maximum contact with the fingernails and thumbnail when the fingers and thumb are inserted into the interior of the polish remover container. Each brush bristle section has spaced bristle rows which are separated to allow a constant flow of nail polish remover or conditioner into the brushing area during the brushing period and continuous circulation of the liquid throughout the container.

It is another object of the invention that the container is disposable, thus preventing the bacterial or viral growths which occur in presently used fingernail cleaning containers as well as disposing of any cuticle material that has been torn or pulled off by the bristles. Presently most fingernail cleaning containers are reused with the user simply adding new acetone into the container. Proper sterilization and hygiene are of the utmost importance to the cosmetology industry and to the individual retail consumer. Cleanliness is of particular importance if the soft tissue surrounding the fingernail, especially the cuticle area, is open and bleeding. This frequently occurs due to job related tearing of the cuticles or from habitual fingernail biting. Such open wound areas are frequently sources for the transmission of dangerous pathogens such as bacterial, fungi, and viruses. It is possible that this could be a pathway for the transmission of acquired immune deficiency syndrome (AIDS) if several people use the same container or if bacterial colonies are allowed to flourish in an old container. Thus the spillage of the cleaning fluid on areas of everyday use could present potential health hazzards.

It is still another object of the invention to provide an internal splash and spillage shield to prevent nail cleaning fluid from being spilled from the container.

Another objective of the present inventive nail polish remover device is to provide the user with a guide for the thumb or finger of a hand into the brush area.

These and other objects, advantages, and novel features of the present invention will become apparent when considered with the teachings contained in the detailed disclosure along with the accompanying drawings.

BRIEF DESCRIPTION OF THE DRAWINGS

FIG. 9 is a top plan view of the bottom container section shown in FIG. 10;

FIG. 10 is a cross sectional view of the bottom container section of the two piece container;

FIG. 11 is an enlarged partial view of the barbs on the inner wall of the bottom section of the two piece container shown in circle C of FIG. 10; and FIG. 12 is an enlarged cutaway view of the bottom container section of the two piece container with a single brush nib shown.

DETAILED DESCRIPTION OF PREFERRED EMBODIMENT

Figure 1:
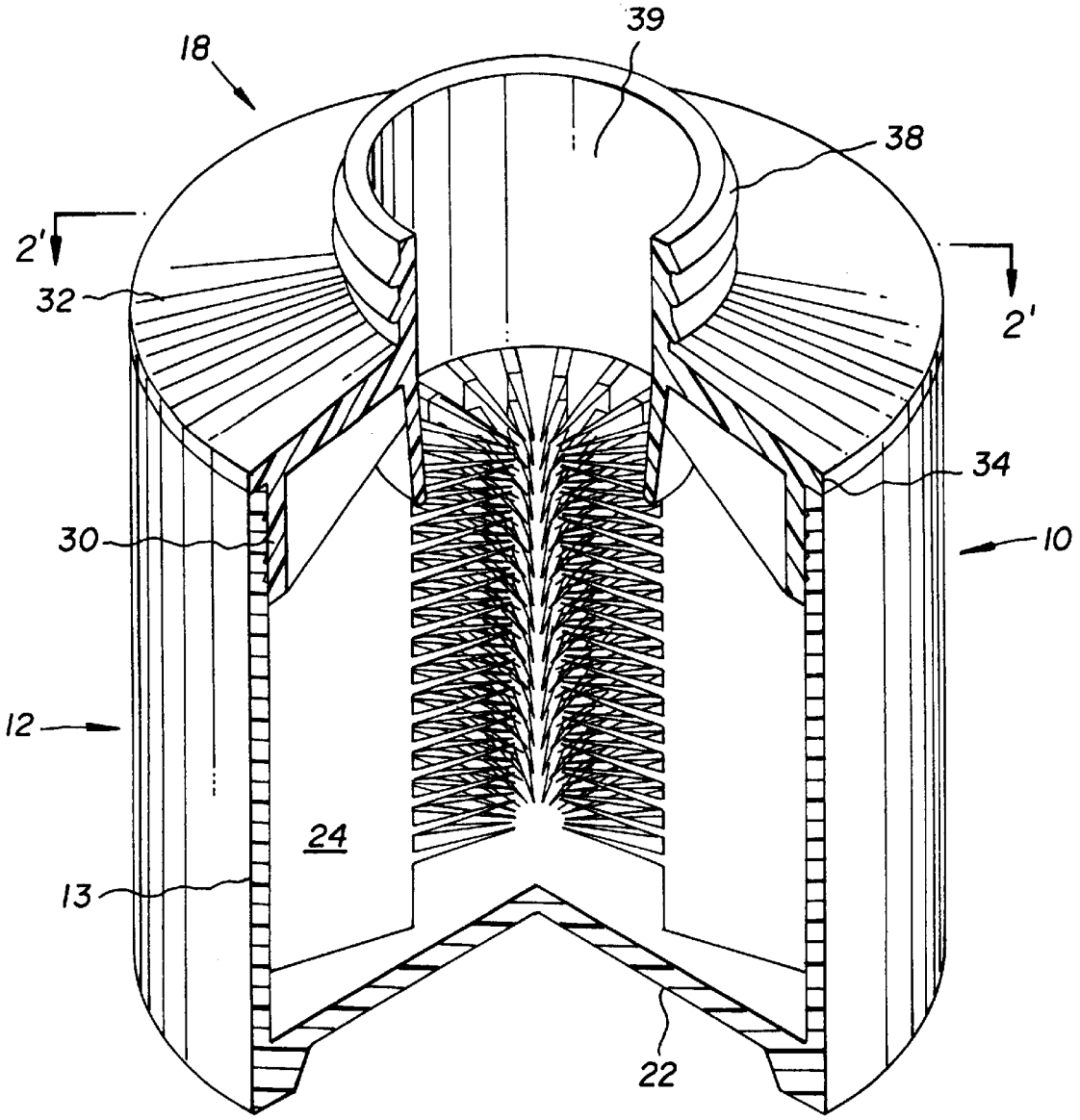
FIG. 1 is a perspective view of the nail polish remover container with a cutaway section showing the interior.
Figure 2:
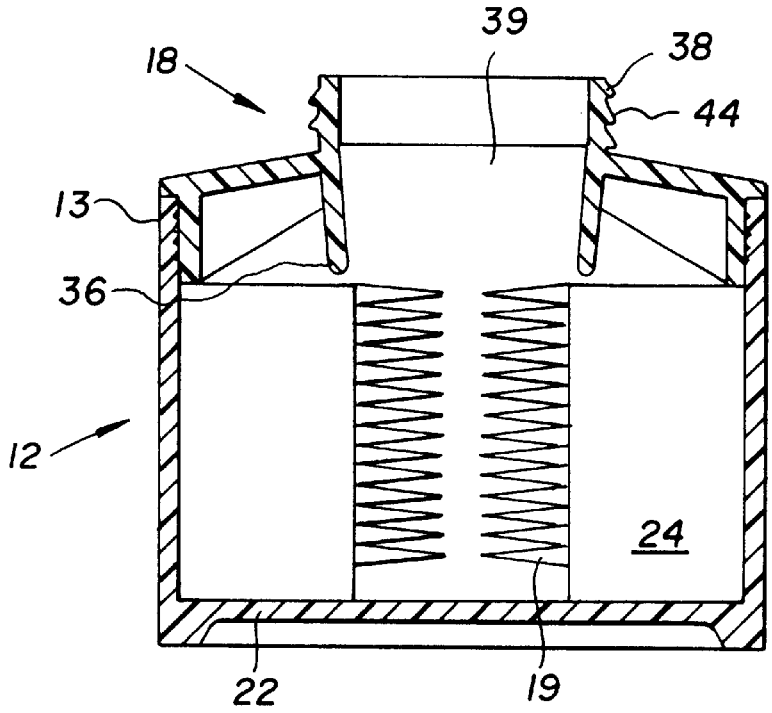
FIG. 2 is a cross sectional view of nail polish remover device with cap removed shown in FIG. 1 taken along line 2'—2' of FIG. 1.
Figure 3:
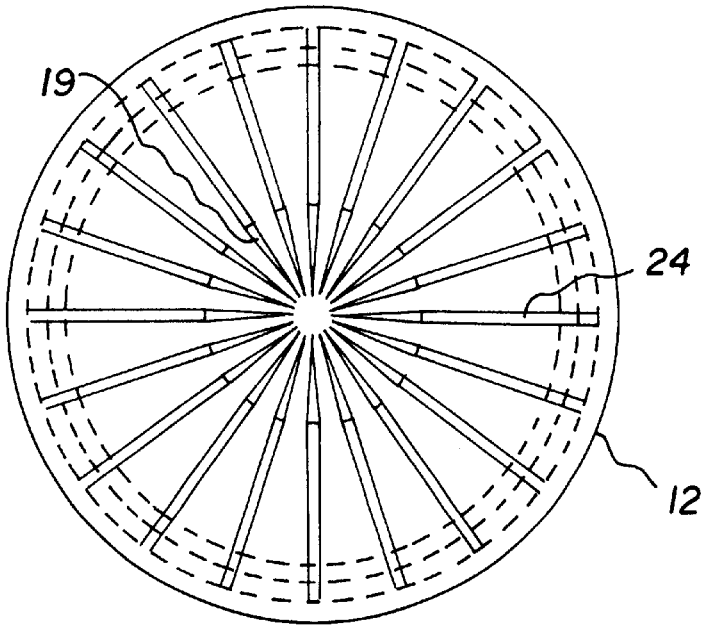
FIG. 3 is a top plan view of FIG. 2 with the cap neck and skirt removed and the walls shown in phantom.
Figure 4:
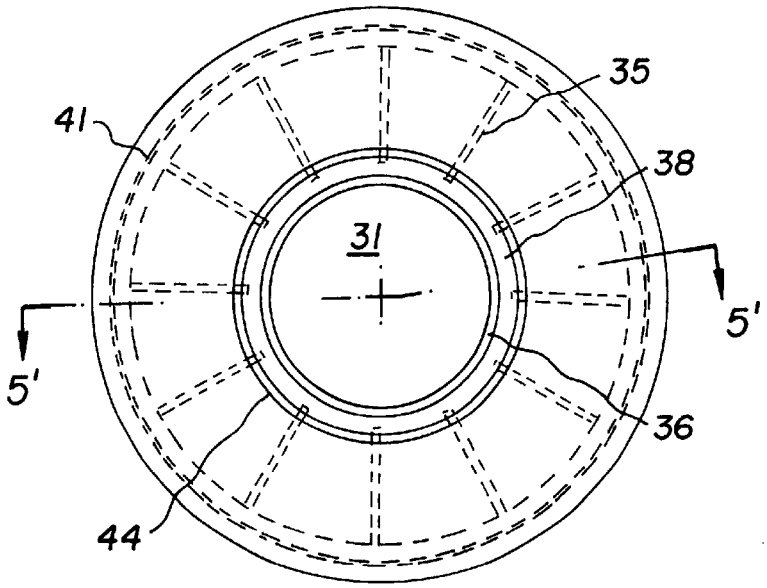
FIG. 4 is a top plan view of FIG. 8 with the walls and rib support members shown in phantom.
Figure 6:
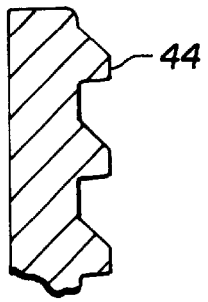
FIG. 6 is an enlarged partial view of the threads of the top section of the two piece container shown in circle A of FIG. 5.
Figure 5:
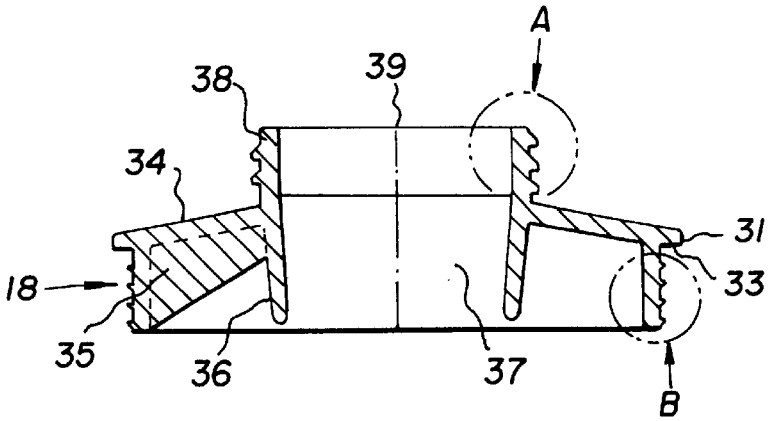
FIG. 5 is a cross section of the top section of the two piece container taken along lines 5'—5' of FIG. 4.

The preferred embodiment and the best mode of the present invention is shown in FIGS. 1 through 12. As shown in the Figures, the inventive nail polish remover container is generally designated by the numeral 10 and comprises two basic components or parts: a cylindrical lower section 12 with integrally molded finger brush members 16, and a top cover section 18 having a molded generally circular shaped cover member 30 with an integrally formed downwardly projecting cylindrical support member 32 located inside the circumference of the cover member 30 defining an outwardly projecting lip 34 when the top cover section is mounted on the cylindrical lower section. The end surface 31 is substantially flush with the outer wall 13 of the cylindrical lower section and the bottom surface 33 is seated upon the top rim surface 14 of the cylindrical section 12. An inwardly projecting funnel or splash member 36 having a throughgoing bore 37 extends from the center portion of the cover member 30 and is axially aligned with a throughgoing bore 39 formed in the threaded cylindrical neck 38. The neck 38 extends outward past the sloped upper exterior wall 34 of the cover member 30 to form a composite central finger aperture 31. A series of support ribs 35 as shown in FIGS. 1, 4 and 5 connect the outer wall of the splash member 36 and the inner wall 42 of the cylindrical base member 32 forming support for both members 32 and 36 aiding in the friction welding of the two sections 12 and 18 together. Each support rib 35 is wider at the distal end adjacent the inner wall 42 of the cylindrical base member 32 running to the end of that wall and narrower at the proximal end adjacent the outer wall of the splash member 36. A threaded cap (not shown) can be screwed to the cap neck 38.

Figure 7:
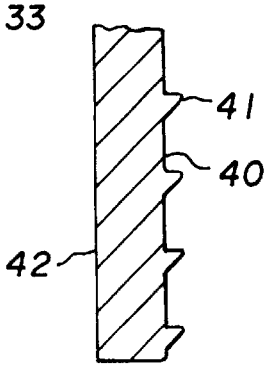
FIG. 7 is an enlarged partial view of the interference barbs of the top section outer wall of the two piece container shown in circle B of FIG. 5.
Figure 8:
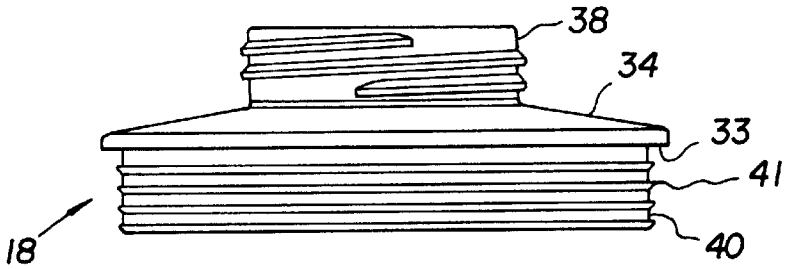
FIG. 8 is a side elevational view of the top section of the two piece container shown in FIG. 4.

The cylindrical container section 12 has a cylindrical wall 20 with an outer wall surface 13 and an inner wall surface 21 is integrally formed with base 22. The cylindrical wall 20 forms a circular opening at the top or proximal end of the container 12 and a number of inwardly projecting brush members 24 are formed with the cylindrical wall 20. The interior upper surface 21*a* of the cylindrical wall 20 is formed with interference barbs 26 as shown in FIGS. 10 and 11 which extend from the surface approximately 0.010 inches to engage and hold the exterior wall 40 of the cylindrical base member 32. The barbs 26 are preferably spaced from each other 0.010 inches. These barbs engage the interference barbs 41 as shown in FIGS. 5 and 7 on the outer wall surface 40 of the downwardly projecting cylindrical base member 32 and can be friction welded to the inner wall surface 21 of the cylindrical wall 20. The interference barbs 41 extend outward from wall surface 40 a distance ranging from 0.02 inches to 0.025 inches.

The top cover 18, is preferably molded of a high density polyurethane plastic and the throughgoing bore 31 in neck 38 and the throughgoing bore 37 in splash member 36 together form a central bore 39 which forms the entry point for a fingers or thumb of the user. Each finger brush member 24 has a row of bristles 19 preferably ranging from 14 to 18 in number which extend inwardly into a chamber 23 formed by the container wall 20 with the bristle ends forming a cylindrical passageway as shown in FIG. 1. The spaces between the bristles 19 and between the rows of bristles allow the nail polish remover solvent placed within the chamber 23 of the container section 12 to flow freely into the brush area.

The cover section 18 is made of a high density polyurethane or polypropylene plastic material that is preferably friction welded by rotating the container section 12 which is of a low density plastic material and cover section 18 which is of a high density plastic material against each other welding the same together.

Variations of the above preferred embodiment are contemplated by the inventor. The cap (not shown) is secured by threading the same to neck 38 of the container 12 by means of screw threads 44 as described above and shown in FIGS. 5, 6 and 8. The screw threads disclosed are 0.125 pitch right hand threads. Other means of attaching the cap which are well-known in the art can be used.

In addition, bristles of different lengths, diameters, and of various shapes and numbers may be used. For example, the tips of the bristles can be conical or pointed, rounded, flat, or chisel shaped. Each bristle blade has a generally triangular base and three flat surfaces. The bristles of the illustrated preferred embodiment are integrally formed with the container 12 by molding them as one piece.

The device is designed so that it can be easily and economically fabricated by injection molding. The entire construction of the container 12 and bristle members 16 is preferably made from a flexible and resilient plastic material such as polyethylene or polypropylene.

In operation the container is filed with polish remover. The user inserts a finger into the container chamber 23 via the finger aperture 39 where the fingernails come in contact with nail polish remover solvent and the tips of the bristles 19 extending into the container chamber. The fingernails are moved across the flexible bristles 19 to score the painted surface, further aiding in the removal of the polish. Upon the removal of the fingers from the nail polish remover device, the bristles revert to their original memory positions.

In the foregoing description, the invention has been described with reference to a particular preferred embodiment, although it is to be understood that specific details shown are merely illustrative, and the invention may be carried out in other ways without departing from the true spirit and scope of the following claims:

What is claimed is:

1. A nail polish remover device comprising:

a cylindrical container member comprising a base, a cylindrical wall mounted to said base defining a top opening and a container chamber, a plurality of brush members extending from an inner wall surface of said cylindrical wall inward into said chamber;

a cover member secured to said cylindrical container member, said cover member comprising a circular cover defining a central aperture, a cylindrical support member secured to said circular cover and extending outward therefrom adapted to engage said cylindrical wall of said container member, a neck portion with a throughgoing bore mounted on a side of said circular cover and a splash portion with a throughgoing bore mounted on an opposite side of said cover member axially aligned with said neck portion, said splash portion extending into said container chamber when said cover member is mounted to said cylindrical container member.

2. A nail polish remover device as claimed in claim 1 wherein each brush member comprises a linear base section with a plurality of bristles extending away from an end wall of said linear base section.

3. A nail polish remover device as claimed in claim 2 wherein said brush members bristles range in number from 14 to 28.

4. A nail polish remover device as claimed in claim 1 wherein said cover member includes a plurality of support ribs which extend outward from said splash member and engage said cylindrical support member.

5. A nail polish remover device as claimed in claim 1 wherein said splash portion is tapered inward.

6. A nail polish remover device comprising:

a cylindrical container with a base and wall means extending from said base defining a top opening and a container chamber;

a plurality of integrally formed brush members mounted to an inner wall of said wall means, each brush member comprising a base section and a plurality of bristles extending away from said base section, said brush members being positioned at equidistant spaced intervals around said inner wall of said wall means with the tips of the bristles defining a cylindrical pathway for insertion of a finger of a user;

a cap member secured to said cylindrical container, said cap member comprising a cover member with a neck portion extending from one side of said cover member, said neck portion defining a throughgoing bore and having an axis which is axially aligned with the axis of said cylindrical pathway defined by said bristle tips, a splash member with a throughgoing bore positioned on the other side of said cover member adjacent to and axially aligned with a central axis of said neck portion, a cylindrical support base integrally formed with and extending away from said cover member forming a seat for said cap member for mounting on said cylindrical container wall means.

7. A nail polish remover device as claimed in claim 6 wherein said cap member is integrally molded of a high density plastic material.

8. A nail polish remover device as claimed in claim 7 wherein said plastic material is polypropylene.

9. A nail polish remover device as claimed in claim 7 wherein said plastic material is polyethylene.

10. A nail polish remover device as claimed in claim 6 wherein said cylindrical container member is molded of low density plastic material and said cap member is molded of high density plastic material.

11. A nail polish remover device as claimed in claim 6 wherein said cap member cylindrical support base has an outer wall provided with a plurality of barbs extending outwardly therefrom.

12. A nail polish remover device as claimed in claim 11 wherein said barbs extend from about 0.020 to about 0.025 inches from said wall.

13. A nail polish remover device as claimed in claim 6 wherein a portion of an upper inner wall of said cylindrical container wall means is provided with a plurality of barbs extending therefrom into the said container chamber.

14. A nail polish remover device as claimed in claim 13 wherein said barbs extend from about 0.010 to about 0.012 inches from said upper inner wall.

15. A nail polish remover device as claimed in claim 6 including a plurality of support ribs secured to said splash member and extending outward to engage said cylindrical support base.

16. A nail polish remover device comprising:

a cylindrical container with a base and wall means extending from said base defining a top opening and a container chamber;

a integrally formed plurality of brush members mounted to an inner wall of said wall means, each brush member comprising a base section and a plurality of bristles extending away from said base section, said brush members being positioned at equidistant spaced intervals around the inner wall of said wall means with the tips of the bristles defining a cylindrical pathway for insertion of a finger of a user;

a cap member with a finger insertion aperture secured to said cylindrical container, said cap member comprising a circular cover member with a cylindrical neck extending from said cover member, said neck defining a throughgoing bore and having an axis which is axially aligned with the axis of said cylindrical pathway defined by said bristle tips, a splash member defining a throughgoing bore positioned on the other side of said cover member adjacent to and axially aligned with said neck and a cylindrical support base integrally formed on said cover member with an outer wall surface of said cylindrical support base being located a distance inward from the circumference of said circular cover member substantially equal to the thickness of the wall means of the cylindrical container and a plurality of ribs integrally connecting said splash member and said cylindrical support base.

17. A nail polish remover device as claimed in claim 16 wherein said neck is threaded to receive a threaded cap.

18. A nail polish remover device as claimed in claim 16 wherein said cover member is secured to said cylindrical wall of said container by heat fusion.

19. A nail polish remover device as claimed in claim 16 wherein said cylindrical support base is provided with a plurality of barbs on its outer wall extending outwardly therefrom.

20. A nail polish remover device as claimed in claim 19 wherein said barbs extend from about 0.020 to about 0.025 inches from said wall.

21. A nail polish remover device as claimed in claim 16 wherein a portion of the upper inner wall of said cylindrical wall is provided with a plurality of barbs extending therefrom into the said chamber.

22. A nail polish remover device as claimed in claim 21 wherein said barbs extend from about 0.010 to about 0.012 inches from said inner wall.

23. A nail polish remover device as claimed in claim 16 wherein each brush member comprises a linear base section with a plurality of bristles extending away from an end wall of said linear base member.

24. A nail polish remover device as claimed in claim 16 wherein said cover member is inclined upward with the outer edge of the circular cover member being located lower on said nail polish remover device then the section of the circular cover member adjacent to said neck.

25. A nail polish remover device as claimed in claim 16 wherein said container is molded of low density plastic and said cover is molded of high density plastic with said container and said cylindrical support base being friction welded together.

26. A nail polish remover device as claimed in claim 16 wherein said splash member is tapered inwardly.

* * * * *